252-147 AU 166 EX
9/6/83 XR 4,402,759

United States Patent [19]

Tytgat

[11] 4,402,759

[45] Sep. 6, 1983

[54] PROCESS FOR INHIBITING THE CORROSION OF A METAL INSTALLATION IN CONTACT WITH AN ACID BATH

[75] Inventor: Daniel Tytgat, Brussels, Belgium

[73] Assignee: Solvay & Cie. (Société Anonyme), Brussels, Belgium

[21] Appl. No.: 184,052

[22] Filed: Sep. 4, 1980

[30] Foreign Application Priority Data

Sep. 17, 1979 [FR] France ..... 79 23283

[51] Int. Cl.[3] ..... C23G 1/06

[52] U.S. Cl. ..... 134/3; 134/18; 134/41; 252/87; 252/147; 252/148

[58] Field of Search ..... 134/3, 18, 41; 252/87, 252/146, 147, 148

[56] References Cited

U.S. PATENT DOCUMENTS 2,831,814 4/1958 Chester et al. ..... 134/3 X
3,440,170 4/1969 Hek ..... 252/147

OTHER PUBLICATIONS

Chemical Abstracts, vol. 85, 1976, Abstract No. 97486d.
*Chemical Abstracts*, vol. 76, 1972, p. 142, Abstract No. 5986e.

*Primary Examiner*—William F. Smith
*Attorney, Agent, or Firm*—Spencer & Kaye

[57] ABSTRACT

The invention relates to a process for inhibiting the corrosion of an installation, made of a material chosen from amongst the metals which are less noble than hydrogen, and their alloys, in contact with an acid bath containing an alkylpyridinium chloride.

A soluble cyanide complex, which is capable of forming an insoluble compound by reacting with ferric ions in the bath, is added to the bath so as to limit the concentration of the ferric ions in the bath to a maximum of 30 mg/kg. The content of ferric ions in the bath is controlled by means of a potentiometric measurement so as to bring the potential of the bath into the region of a predetermined value.

The invention applies in particular to the treatment of baths for cleaning or descaling steel installations.

11 Claims, 3 Drawing Figures

PROCESS FOR INHIBITING THE CORROSION OF A METAL INSTALLATION IN CONTACT WITH AN ACID BATH

BACKGROUND OF THE INVENTION

The present invention relates to a process for inhibiting the corrosion of metal installations in contact with an acid bath. It relates more particularly to a process for inhibiting the corrosion, in contact with aqueous baths containing a mineral acid, of installations made of metals which are less noble than the hydrogen in these baths.

It is known to treat metal installations with acid baths, in particular for the purpose of cleaning them or descaling them. These cleaning and descaling techniques are commonly employed in industry, where they are used in particular for descaling steel boilers and for descaling crystallisation reactors, such as the steel or cast iron columns used for the crystallisation of sodium bicarbonate in the ammonia process for the manufacture of soda, or the nickel evaporators used for the crystallisation of sodium chloride starting from brines of from aqueous solutions of sodium chloride and sodium hydroxide.

The acid baths used in these cleaning and descaling processes must generally contain a corrosion inhibitor, the function of which is to prevent deterioration of the installation without detracting from the cleaning or descaling action of the bath.

The corrosion inhibitors added to the acid baths also serve the purpose of preventing corrosion of the installations used for handling them, in particular the storage vats, the collectors and their accessories, such as gate valves, clack valves and pumps.

In the particular case of steel or cast iron installations, an alkylpyridinium chloride is normally used as the corrosion inhibitor. However, it has been observed, in practice, that despite the presence of the alkylpyridinium chloride in the acid baths, the latter still cause corrosion, and sometimes rapid corrosion, of the installation in certain cases.

A known process for overcoming this disadvantage consists in adding stannous chloride to the bath, in addition to the alkylpyridinium chloride.

However, this known process exhibits the disadvantage of contaminating the bath with tin ions, which are generally considered as dangerous, in particular if the baths are discharged into watercourses.

Another known process for removing a film of oxide from the surface of components made of mild steel consists in treating them with a cleaning paste consisting of a mixture of phosphoric acid, potassium ferrocyanide, urea, zinc phosphate, sawdust, molasses and decylpyridinium chloride (Chemical Abstracts, 1976, Volume 85, No. 97486d).

However, the use of a paste for cleaning industrial installations presents serious difficulties, in particular in the case of installations of large dimensions, or if the paste is used to treat zones of the installation which are not easily accessible.

SUMMARY OF THE PRESENT INVENTION

The object of the invention is to overcome the above-mentioned disadvantages of the known processes by providing a process for preventing the corrosion of metal installations in contact with acid baths containing an alkylpyridinium chloride, which process is both inexpensive and harmless to the environment.

The invention therefore relates to a process for inhibiting the corrosion, in contact with an aqueous bath containing a mineral acid and an alkylpyridinium chloride, of an installation made of a metal which is less noble than the hydrogen in the said bath, or of an alloy containing a metal of this type; according to the invention, a soluble cyanide complex, which is capable of forming an insoluble compound by reacting with ferric ions in the bath, is added to the bath in an adjusted amount between that which is necessary to keep, in the bath in contact with the installation, a concentration of ferric ions equal to 30 mg/kg, and that which is strictly necessary to obtain a zero concentration of ferric ions therein.

DETAILED DESCRIPTION OF THE INVENTION

Figure 1:
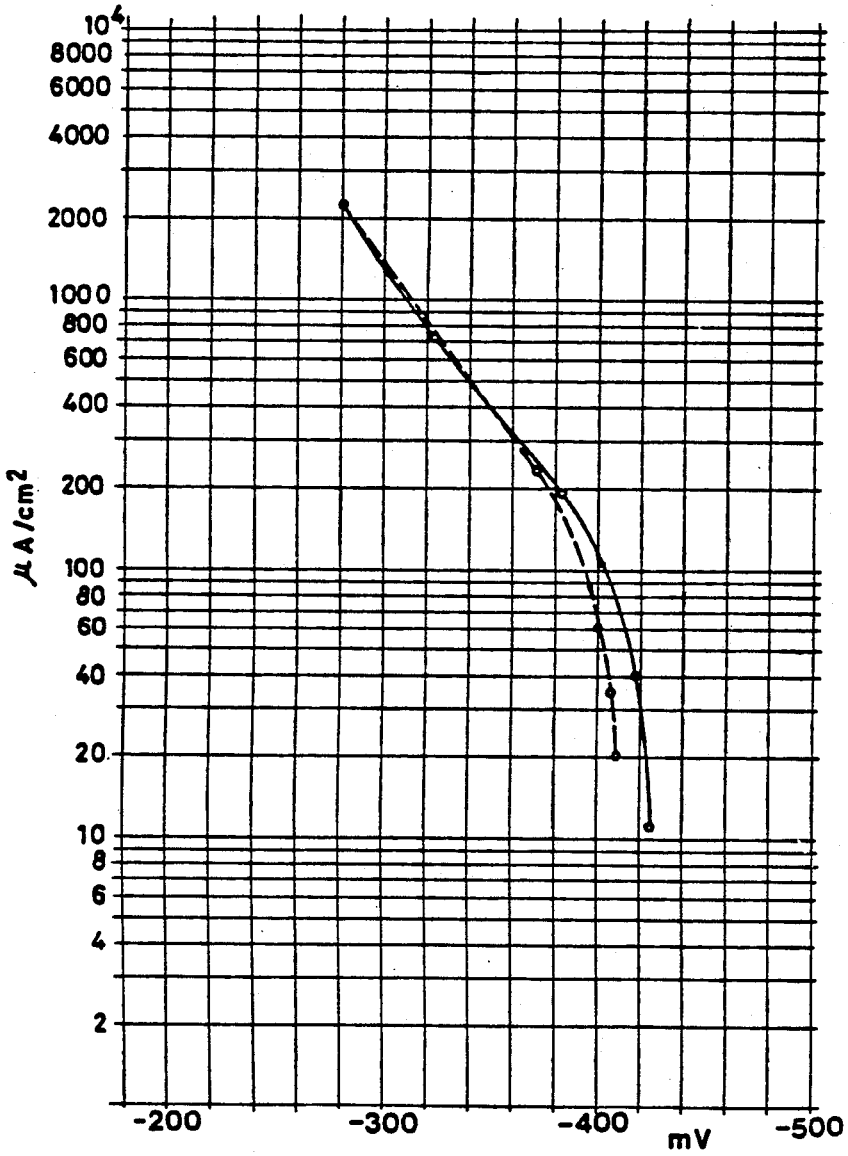

In the process according to the invention, the expression "metal which is less noble than the hydrogen in the bath" is understood as denoting any metal of which the equilibrium potential in the aqueous acid bath in question is less than the equilibrium potential of hydrogen in the same bath and under the same conditions of use. In other words, these are metals which cause the evolution of hydrogen in the even of corrosion in contact with the bath (Atlas d'équilibres électrochimiques (Atlas of Electrochemical Equilibria)—M. Pourbaix—Gauthier—Villars and Cie, publishers—1963—pages 75 and 76). Chromium, iron, cobalt, nickel and zinc are examples of metals which fall within the scope of the invention. The expression "alloy of a metal of this type" is understood as denoting all the alloys of which at least one of the constituent elements is a metal which is less noble than hydrogen, as defined above. It therefore denotes at one and the same time the alloys which are less noble than hydrogen (for example ordinary steel and cast iron) and the alloys which are more noble than hydrogen (for example the cupronickels, which are nickel/copper alloys containing from 70 to 85% of copper).

In the process according to the invention, the choice of the mineral acid in the bath is not critical and essentially depends on the nature of the treatment. By way of example, in the case where the process is applied to the removal of calcium carbonate scales from the walls of the installation, the mineral acid is advantageously hydrochloric acid, the bath consisting, for example, of an aqueous solution containing from 0.01 to 3 mols of hydrochloric acid per liter. A normal solution of hydrochloric acid is particularly suitable as the bath for treating installations made of iron or an iron alloy.

The purpose of the alkylpyridinium chloride is to prevent corrosion of the installation by acid. It is preferably chosen from amongst those derived from alkanes possessing from 10 to 18 carbon atoms. Cetyl-, myristyl- and lauryl-pyridinium chloride have proved particularly advantageous.

All other things being equal, in the case of steel or cast iron installation, a mixture of alkylpyridinium chlorides containing laurylpyridinium chloride as the main product, and smaller amounts of myristylpyridinium chloride and cetylpyridinium chloride, has proved to be the most active inhibitor.

The content of alkylpyridinium chloride in the bath depends on various factors, in particular the choice of the acid, the concentration of this acid in the bath, the temperature of the bath, the nature of the material of which the installation is made, the duration of the treatment of the installation with the bath, and the choice of the alkylpyridinium chloride. It can be determined in each particular case by means of a routine laboratory experiment.

By way of example, in the case where the bath is a normal solution of hydrochloric acid, good results are generally obtained by fixing the content of alkylpyridinium chloride in the bath at between 0.5 and 5,000 mg/kg, preferably between 2 and 500 mg/kg. Preferred baths for treating installations made of mild steel or cast iron are normal solutions of hydrochloric acid containing about 75 to 200 mg of laurylpyridinium chloride per kg of solution.

According to the invention, a soluble cyanide complex, which is capable of reacting with ferric ions in the bath in order to form an insoluble compound, is added to the bath.

In fact, it has been observed that the corrosion of metal installations by acid baths containing an alkylpyridinium chloride seems to be related to the presence of ferric ions in these baths. The ferric ions in the bath can originate from various sources. In particular, they are originate from the installation itself, if the latter is made of iron or an iron alloy, whether they result from corrosion of the installation or whether they are localised in a scale dissolved in the bath in the case of a descaling treatment. These ions can also originate from local corrosion of an iron-based component which is outside the actual installation and with which the bath is momentarily brought into contact. This possibility can arise, in particular, in this case where an installation made of a metal which is less noble then hydrogen, or of an alloy containing a metal of this type, is subjected to a cleaning or descaling treatment by means of an acid bath originating from a handling circuit comprising steel or cast iron components suffering local corrosion.

The cyanide complexes constitute a class of very stable chemical complexes, which is well known in technology (Encyclopaedia of Chemical Technology—Kirk and Othmer—The Interscience Encyclopaedia, Inc.—19—Volume 4, pages 677 to 680). They consist of complex anions containing at least one central metal atom bonded to cyanide groups by coordination.

According to the invention, the cyanide complex must be chosen from amongst those which are soluble in the aqueous acid baths and which, by reacting with the ferric ions, form insoluble cyanide compounds.

The ferricyanide and ferrocyanide complexes are examples of cyanide complexes which are suitable within the scope of the invention.

All other things being equal, it is preferred, according to the invention, to use tetravalent cyanide complexes, ferrocyanide being more particularly preferred.

The cyanide complex can be introduced into the bath in the form of a water-soluble compound.

Water-soluble compounds which have proved particularly advantageous are hexacyanoferric acid and the ferrocyanides of calcium, ammonium, sodium and potassium, potassium ferrocyanide being preferred.

According to a characteristic of the invention, the amount of soluble cyanide complex added should be limited to the minimum amount which is strictly necessary to produce a zero concentration of ferric ions in the bath in the immediate vicinity of the installation.

In fact, experience has shown that an excess of ions of this complex in the bath has the unfavourable result of detracting from the inhibiting character of the alkylpyridinium chloride and thus of causing accelerated corrosion of the installation.

It is generally desirable, as a safety measure, to adjust the amount of cyanide complex added to the bath so that the residual content of ferric ions in the bath in the vicinity of the installation, is equal to at least 0.1 mg/kg.

The amount of this soluble cyanide complex added to the bath must furthermore be sufficient to keep the residual content of ferric ions, in the bath in the vicinity of the installation, below a critical value at any moment, their influence on the corrosion of the installation becoming unacceptable above this critical value.

All other things being equal, the fixing of the abovementioned critical value of the residual content of ferric ions, in the bath in the vicinity of the installation, will depend on a large number of parameters, such as the nature of the material of which the installation is made, the nature and the concentration of the mineral acid in the bath, the temperature of the bath and the duration of the treatment.

In general terms, in the majority of cases, the amount of soluble cyanide complex added should be adjusted so that the residual content of ferric ions, in the bath in contact with the installation, does not exceed 30 mg/kg. Suitable values for the amount of cyanide complex added to the bath are those which lead to the production of a residual content of ferric ions, in the bath in contact with the installation, of between 20 and 0.5 mg/kg, preferably between 5 and 1 mg/kg.

Any appropriate technique can be used for adjusting the amount of cyanide complex added to the bath.

According to a preferred embodiment of the invention, the amount of soluble cyanide complex added to the bath is adjusted by measuring the potential, in the bath, of the material of which the installation is made.

In fact, it has been observed that, for a determined composition of the bath and a defined material of which the installation is made, the magnitude of the potential, in the bath, of the material of which the installation is made is a measure of its content of ferric ions.

It therefore suffices, during the treatment of the installation, to adjust the amount of soluble cyanide complex added to the bath, so as to keep the potential of the material of which the installation in contact with the bath is made permanently between two predetermined critical values, respectively corresponding to the extreme tolerated values of the ferric ions in the bath in contact with the installation. These critical values of the potential can easily be determined by means of a routine laboratory experiment reproducing the conditions envisaged for the treatment of the installation.

Furthermore, it has been observed that a gradual reduction in the content of ferric ions, in the bath in contact with the material of which the installation is made, leads to a gradual reduction in the potential of this material until a fixed value is reached, which corresponds to a zero content of ferric ions in the bath in contact with the material; moreover, the addition of an excess amount of the soluble cyanide complex, relative to the amount which is strictly necessary to reduce to zero the content of ferric ions in the bath in contact with the material of which the installation is made, does not exert any influence on the value of the potential of this material, which therefore retains the abovementioned fixed value. Obviously, this fixed value of the potential can easily be determined by means of a routine laboratory experiment, so that, according to an advantageous embodiment of the invention, it suffices to adjust the amount of complex added to the bath so as to keep the potential of the material of which the installation is made permanently in the region of this fixed value.

The method used for measuring the potential, in the bath, of the material of which the installation is made is not critical. For example, it is possible to use, for this purpose, an electrochemical measuring cell comprising a reference electrode (for example a hydrogen electrode or a calomel electrode) and a load electrode which is made of the same material as the installation and is immersed in the bath in the immediate vicinity of the installation.

The load electrode can be a metal bar, for example a cylindrical bar. However, according to a particular embodiment of the invention, it is preferred to use, as the load electrode, a zone of the installation which is in contact with the bath, for example the wall of a vat or of a pipeline, the cut-off flap of a gate valve or also the wheel or the casing of a pump.

The process according to the invention finds a valuable application in the descaling of evaporators made of nickel or a nickel alloy, which are used for crystallising sodium chloride starting from caustic brines produced by the electrolysis of a sodium chloride brine in an electrolysis cell with a permeable diaphragm. Another valuable application of the process according to the invention is in the descaling of the cooling zone of columns used for the crystallisation of sodium bicarbonate in the ammonia process for the manufacture of soda (Manufacture of soda —Te-Pang Hou—Hafner Publishing Co.—1969).

The process according to the invention can also be applied to the handling of mineral acids in aqueous solution, in pipelines or metal tanks.

In the particular case in which the material of which the installation is made is an alloy containing both a metal which is less noble than hydrogen, as defined above, and a metal which is more noble than hydrogen, it can prove desirable to add to the bath, in addition to the alkylpyridinium chloride and the cyanide complex, a substance which is in itself known for inhibiting the corrosion of metals which are more noble than hydrogen, by aqueous acid baths.

Potassium iodide proves to be a preferred substance for inhibiting the corrosion of metals of this type.

Examples of alloys for which it is appropriate to add a corrosion inhibitor of this kind to the aqueous acid baths are the cupronickels, which are nickel/copper alloys generally containing from 70 to 85% of copper and from 15 to 30% of nickel (Traité de Métallurgie Structurale (Treatise on Structural Metallurgy)—A. De Sy and J. Vidts—Dunod—1962—page 184).

The advantage of the invention will become apparent in the course of the following description of a few application examples, with reference to the attached drawings, which are three graphs respectively reproducing the results of the experiments described in the examples.

In each of the application examples which now follow, the influence exerted by the presence of the ferric ions in a hydrochloric acid bath containing laurylpyridinium chloride, on the corrosion of a chosen metallic material, was examined first. The beneficial influence exerted by the addition of potassium ferrocyanide to this bath, on the protection of the material against corrosion, was then examined.

For this purpose, the cell used was an electrochemical measuring cell comprising a load electrode which was made of the material under study and immersed in a normal aqueous solution of hydrochloric acid, containing, per kg, 100 mg of the product known by the name "Dehyquart C" (Henkel Int. GmbH), which consists mainly of laurylpyridinium chloride.

The load electrode consisted of a cylindrical bar of which the surface in contact with the bath had an area equal to 10 $cm^2$.

EXAMPLE 1

The experiment was carried out with a load electrode made of ordinary steel.

During a first stage of the experiment, five consecutive amounts of ferric chloride hexahydrate were added to the solution in the measuring cell. The consecutive amounts of ferric chloride added were adjusted so as to bring the content of ferric ions in the solution successively equal to 10, 30, 100, 300 and 1,000 mg/kg.

After each addition of ferric chloride, a potentiometric method was used to measure, on the one hand, the intensity of the current in the electrode, which is a measure of its corrosion rate, and, on the other hand, the equilibrium potential of the electrode in the bath, relative to the calomel reference electrode saturated with KCl. The results are recorded in Table I below.

TABLE I

| Concentration of $Fe^{3+}$ ions in the bath (mg/kg) | Current ($\mu A/cm^2$) | Potential (mV) |
|---|---|---|
| 10 | 11 | −425 |
| 30 | 40 | −418 |
| 100 | 190 | −383 |
| 300 | 725 | −323 |
| 1,000 | 2,250 | −280 |

After the first stage of the experiment, the second stage of the experiment was started immediately and five consecutive amounts of potassium ferrocyanide trihydrate were added to the solution in the measuring cell during this second stage. The consecutive amounts of potassium ferrocyanide added were adjusted so that the residual content of ferric ions was brought successively to 300, 100, 30, 10 and 0 mg/kg. The results of this second stage of the experiment are mentioned in Table II.

TABLE II

| Concentration of residual $Fe^{3+}$ ions in the bath (mg/kg) | Current ($\mu A/cm^2$) | Potential (mV) |
|---|---|---|
| 300 | 850 | −316 |
| 100 | 260 | −372 |
| 30 | 60 | −400 |
| 10 | 35 | −405 |
| 0 | 20 | −409 |

The results of the two stages of the experiment are reproduced in the graph of FIG. 1, in which the scale of the abscissa represents the equilibrium potential of the load electrode of the measuring cell, expressed in mV, and the scale of the ordinate is a logarithmic scale of the intensity of the electric current in the load electrode, expressed in $\mu A$ per $cm^2$ of the immersed surface area of the electrode. The curve which is a continuous line reproduces the results of the first stage of the experiment and shows the unfavourable action of the ferric ions on the corrosion of the electrode. The curve which is a broken line reproduces the results of the second stage of the experiment; it shows, on the one hand, that the adverse influence of the ferric ions is inhibited by adding potassium ferrocyanide, and, on the other hand, that the addition of potassium ferrocyanide causes the equilibrium potential of the metal to decrease towards a fixed limiting value.

EXAMPLE 2

The two stages of the experiment of Example 1 were repeated using a load electrode made of 316 L-type steel (A.S.T.M. Standard Specifications), which is an austenitic stainless steel having the following composition by weight (Techniques de l'Ingénieur (Techniques of the Engineer)—Métallurgie (Metallurgy)—Volume I—Form. M 323—17—1974):

| | |
|---|---|
| C | maximum 0.03% |
| Mn | maximum 2.0% |
| Si | maximum 1.0% |
| P | maximum 0.045% |
| S | maximum 0.030% |
| Cr | 16.0–18.8% |
| Ni | 10.0–14.0% |
| Mo | 2.0–3.0% |

Figure 2:
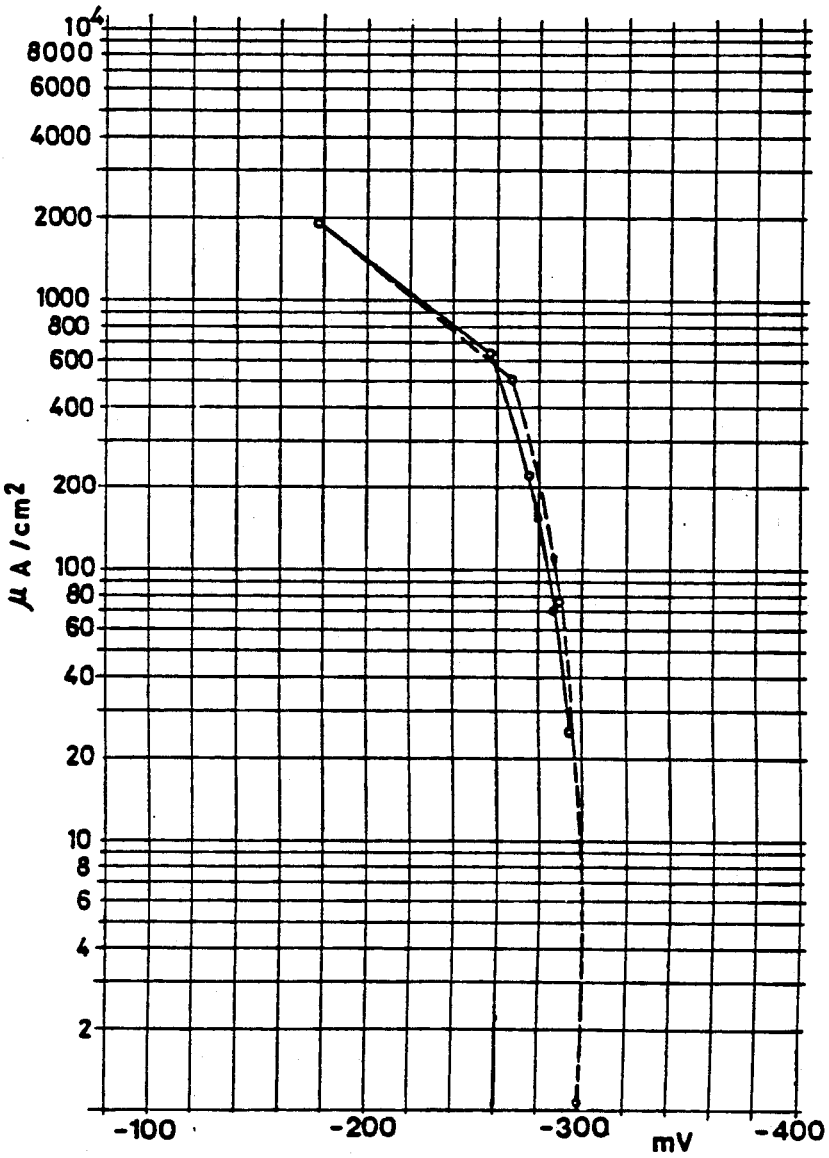

The results of the two stages of the experiment are recorded in Tables III and IV and reported in the graph of FIG. 2.

TABLE III

| Concentration of $Fe^{3+}$ ions in the bath (mg/kg) | Current ($\mu A/cm^2$) | Potential (mV) |
|---|---|---|
| 10 | 25 | −294 |
| 30 | 70 | −286 |
| 100 | 220 | −275 |
| 300 | 625 | −257 |
| 1,000 | 1,900 | −177 |

TABLE IV

| Concentration of residual $Fe^{3+}$ ions in the bath (mg/kg) | Current ($\mu A/cm^2$) | Potential (mV) |
|---|---|---|
| 300 | 500 | −268 |
| 30 | 75 | −290 |
| 0 | 1.05 | −299 |

EXAMPLE 3

The two successive stages of the experiment of Example 1 were repeated, this time using load electrodes made of an alloy known by the name Monel 400 (Huntington Alloy Products Division and International Nickel Company Inc.), which is a nickel/copper alloy having the following composition by weight (Römpps Chemie—Lexikon (Römpps Chemistry Encyclopaedia), 1974):

| | |
|---|---|
| Ni (+Co) | ≧63% |
| Mn | 2% |
| C | 0.3% |
| Fe | 2.5% |
| S | 0.024% |
| Si | 0.5% |
| Cu | remainder |

Figure 3:
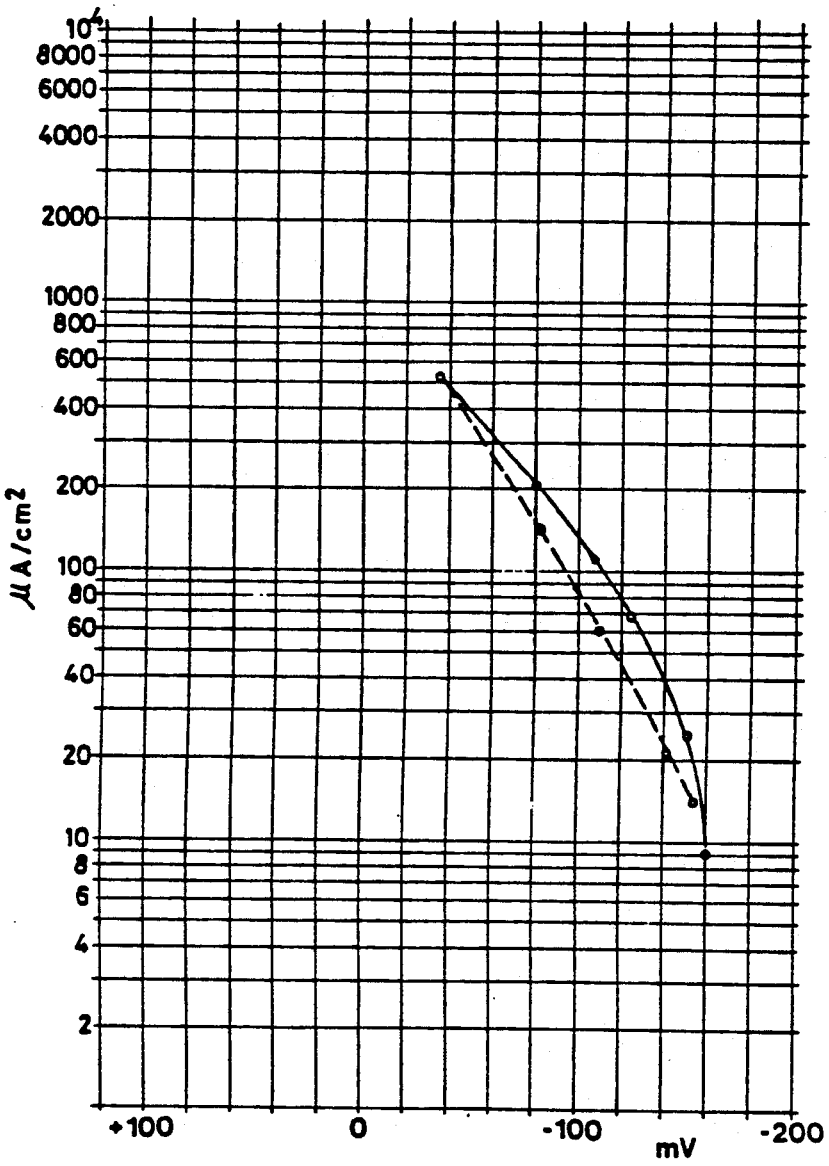

The results of the two stages of the experiment are recorded respectively in Tables V and VI and reported on the graph of FIG. 3.

TABLE V

| Concentration of $Fe^{3+}$ ions in the bath (mg/kg) | Current ($\mu A/cm^2$) | Potential (mV) |
|---|---|---|
| 10 | 9 | −160 |
| 30 | 25 | −141 |
| 100 | 68 | −124 |
| 300 | 205 | −80 |
| 1,000 | 525 | −35 |

TABLE VI

| Concentration of residual $Fe^{3+}$ ions in the bath (mg/kg) | Current ($\mu A/cm^2$) | Potential (mV) |
|---|---|---|
| 300 | 140 | −82 |
| 100 | 60 | −110 |
| 30 | 21 | −142 |
| 10 | 14 | −154 |

I claim:

1. Process for inhibiting the corrosion, of an installation in contact with an aqueous bath containing a mineral acid and an alkylpyridinium chloride, the installation being made of a metal which is less noble than hydrogen in the bath or of an alloy containing a metal of this type, wherein ferric ions are formed in the bath, comprising: treating the installation by adding to the bath a soluble cyanide complex, which is capable of forming an insoluble compound by reacting with ferric ions in the bath, measuring the concentration of ferric ions in the bath, and adjusting the amount of said soluble cyanide complex added to the bath during the treating so as to permanently keep, in the bath in contact with the installation, a concentration of ferric ions between 30 mg/kg and a zero concentration, and that with a zero concentration the adjusted amount of the soluble cyanide complex added is that which is strictly necessary to obtain a zero concentration of ferric ions therein.

2. Process according to claim 1, wherein the soluble cyanide complex used is tetravalent.

3. Process according to claim 2, wherein ferrocyanide is used as the soluble cyanide complex.

4. Process according to claim 3, wherein the ferrocyanide complex is added to the bath in the form of potassium ferrocyanide.

5. Process according to any one of claims 1 to 4, wherein the amount of soluble cyanide complex added to the bath is adjusted so as to keep the concentration of ferric ions in the bath between 5 and 1 mg/kg.

6. Process according to any one of claims 1 to 4, wherein the amount of soluble cyanide complex added to the bath is adjusted by measuring the potential of the material of which the installation is made.

7. Process according to any one of claims 1 to 4, wherein hydrochloric acid is used as the mineral acid.

8. Process according to claim 7, wherein a normal solution of hydrochloric acid containing from 75 to 200 mg of an alkylpyridinium chloride is used as the bath.

9. Process according to any one of claims 1 to 4, wherein the alkylpyridinium chloride is chosen from amongst those derived from alkanes possessing from 10 to 18 carbon atoms.

10. Process according to any one of claims 1 to 4, wherein the installation is made of chromium, zinc, iron, cobalt, nickel or an alloy of these metals.

11. In a process for treating an installation made of metal which is less noble than hydrogen or of an alloy containing a metal of this type, by contacting the installation with an aqueous bath containing a mineral acid and alkylpyridinium chloride, wherein ferric ions are formed in the bath, the improvement comprising: adding to the bath a soluble cyanide complex which is capable of forming an insoluble compound by reacting with ferric ions in the bath, measuring the concentration of ferric ions in the bath, and adjusting the amount of said soluble cyanide complex added to the bath during the treating in order to keep the amount of ferric ions in the bath permanently between 0.1 and 30 mg/kg.

* * * * *